US007772939B2

(12) United States Patent
Watanabe et al.

(10) Patent No.: US 7,772,939 B2
(45) Date of Patent: Aug. 10, 2010

(54) POLARIZATION TRANSFORMATION CIRCUIT

(75) Inventors: Naotsugu Watanabe, Tokyo (JP); Takayuki Oyama, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/902,007

(22) Filed: Sep. 18, 2007

(65) Prior Publication Data

US 2008/0068274 A1 Mar. 20, 2008

(30) Foreign Application Priority Data

Sep. 19, 2006 (JP) ..... 2006-252679

(51) Int. Cl.
*H01P 1/165* (2006.01)

(52) U.S. Cl. ..... 333/21 A; 333/21 R

(58) Field of Classification Search ..... 333/21 R, 333/21 A, 248, 251

See application file for complete search history.

(56) References Cited

U.S. PATENT DOCUMENTS

| | | | | |
|---|---|---|---|---|
| 6,583,683 | B2 * | 6/2003 | Schubert et al. | 333/21 A |
| 7,212,087 | B2 * | 5/2007 | Nagai | 333/210 |

FOREIGN PATENT DOCUMENTS

| | | | |
|---|---|---|---|
| DE | 36 07 847 | A1 | 9/1987 |
| DE | 36 32 545 | A1 | 3/1988 |
| DE | 37 33 397 | C1 | 3/1989 |
| EP | 0 986 123 | A3 | 3/2000 |
| EP | 1 067 616 | A3 | 1/2001 |
| EP | 1 394 891 | A1 | 3/2004 |
| JP | 38-9883 | | 5/1962 |
| JP | 52-115146 | | 9/1977 |
| JP | 57-43601 | | 8/1980 |
| JP | 6-61701 | | 3/1994 |
| JP | 7-22882 | | 5/1995 |
| JP | 2748518 | | 2/1998 |
| JP | 2945839 | | 6/1999 |
| JP | 3211617 | | 7/2001 |
| JP | 2004-363764 | | 12/2004 |
| JP | 2005-269589 | | 9/2005 |

OTHER PUBLICATIONS

Japanese Office Action dated Jan. 14, 2010 with English translation thereof.

European Search Report dated Nov. 20, 2007.

Bornemann J, "Short and machinable 90° twists for integrated waveguide applications" Microwave Symposium Digest, 1994., IEEE MTT-S International San Diego, CA, USA, May 23-27, 1994, New York, NY, USA, IEEE, May 23, 1994, pp. 233-236.

* cited by examiner

*Primary Examiner*—Robert Pascal
*Assistant Examiner*—Kimberly E Glenn
(74) *Attorney, Agent, or Firm*—McGinn IP Law Group, PLLC

(57) ABSTRACT

An apparatus adapted for easily performing polarization switching is disclosed. Within a second waveguide connected to a first waveguide, there is embedded a polarization transformation circuit in the state rotated relative to the second waveguide at an angle set, based on a reflection characteristic indicating a characteristic of a reflection coefficient with respect to a polarization frequency.

13 Claims, 4 Drawing Sheets

POLARIZATION TRANSFORMATION CIRCUIT

This application is based upon and claims the benefit of priority from Japanese Patent Application No. 2006-252679 filed on Sep. 19, 2006, the content of which is incorporated by reference.

BACKGROUND OF THE INVENTION

1. Field of the Invention

The present invention relates to a waveguide apparatus used for an antenna for transmitting and receiving microwave and milliwave signals, and more particularly, to a waveguide apparatus including a polarization transformation circuit for switching between a horizontally polarized wave and a vertically polarized wave in a linear polarized wave.

2. Description of the Related Art

In conventional waveguide apparatuses in which plural waveguides are connected, a polarization transformation circuit is used in order to connect plural waveguides. This polarization transformation circuit is a circuit for performing an impedance matching between the output impedance of one waveguide and the input impedance of another waveguide connected to the waveguide.

Referring to FIG. 1, there is illustrated a waveguide apparatus comprising waveguides 1001, 1002, and polarization transformation circuits 1003, 1004. By polarization transformation circuits 1003, 1004, matching between output impedance of waveguide 1001 and input impedance of waveguide 1002 is performed. In this example, since waveguides 1001 and 1002 are disposed so that the vibration directions of polarized waves that passed through respective waveguides 1001 and 1002 are horizontal to each other, no impedance miss-matching between the output impedance of waveguide 1001 and the input impedance of waveguide 1002 occurs. Accordingly, in order to perform impedance matching between the output impedance of waveguide 1001 and the input impedance of waveguide 1002, it is not necessary to rotate polarization transformation circuits 1003, 1004.

Referring to FIG. 2, similarly to the waveguide apparatus shown in FIG. 1, there is illustrated a waveguide apparatus comprising waveguides 1001, 1002, and polarization transformation circuits 1003, 1004. Impedance matching between the output impedance of waveguide 1001 and the input impedance of waveguide 1002 is performed using polarization transformation circuits 1003, 1004. In this example, since waveguides 1001 and 1002 are disposed so that the vibration directions of polarized waves that passed through respective waveguides 1001 and 1002 that are perpendicular to each other, impedance miss-matching between the output impedance of waveguide 1001 and the input impedance of waveguide 1002 will occur. For this reason, every time polarization wave switching is performed, in order to perform impedance matching between the output impedance of waveguide 1001 and the input impedance of waveguide 1002, it is necessary to respectively rotate respective polarization transformation circuits 1003, 1004 by suitable angles.

Moreover, a technology capable of performing, in a manner integral with the waveguide, polarization wave switching in the case where the vibration directions of input/output polarized waves of the waveguides are perpendicular to each other is disclosed in the JP2004-363764A.

However, in the case where plural waveguides are disposed so that vibration directions of input/output polarized waves of the waveguides are perpendicular to each other, it is necessary to perform impedance matching between respective waveguides. Further, in order to ensure that those waveguides have sufficient characteristics, there is the problem that it is necessary to have polarization transformation circuitry comprising two or more parts to perform impedance matching between both waveguides. Moreover, the problem that the plural parts that constitute the polarization transformation circuitry need to rotate, at a suitable angle, each time polarization wave switching is performed occurs.

In addition, in the technology disclosed in the above-mentioned patent document, there is the problem that since a fixed structure is employed only in the case where the vibration directions of input/output polarized waves of the waveguides are perpendicular to each other, such technology cannot be utilized as it is in the case where the vibration directions of input/output polarized waves of the waveguides are horizontal to each other.

SUMMARY OF THE INVENTION

An object of the present invention is to provide a waveguide apparatus capable of easily performing polarization switching.

In the present invention as constituted above, the polarization transformation circuit is embedded within the second waveguide connected to the first waveguide in a state rotated relative to the second waveguide at an angle that is set, based on a reflection characteristic indicating a characteristic of a reflection coefficient with respect to a waveguide polarization frequency.

Thus, the number of parts resulting from integration of parts can be reduced, and polarization wave switching work can be facilitated. Further, it is possible to easily perform polarization wave switching.

The above and other objects, features, and advantages of the present invention will become apparent from the following description with reference to the accompanying drawings which illustrate an example of the present invention.

EXEMPLARY EMBODIMENT

Figure 1:
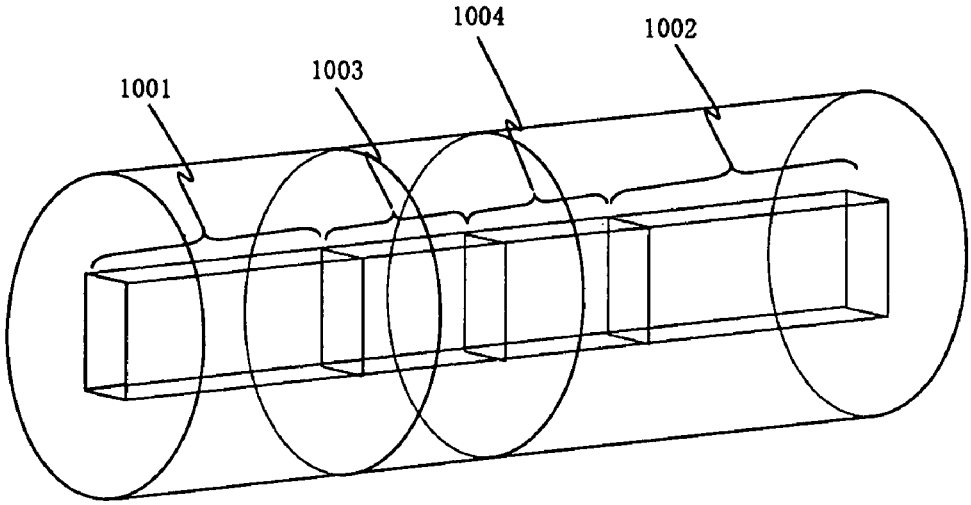
FIG. 1 is a view showing an example of a waveguide apparatus in the case where the vibration directions of input/output polarized waves of waveguides are horizontal to each other.
Figure 2:
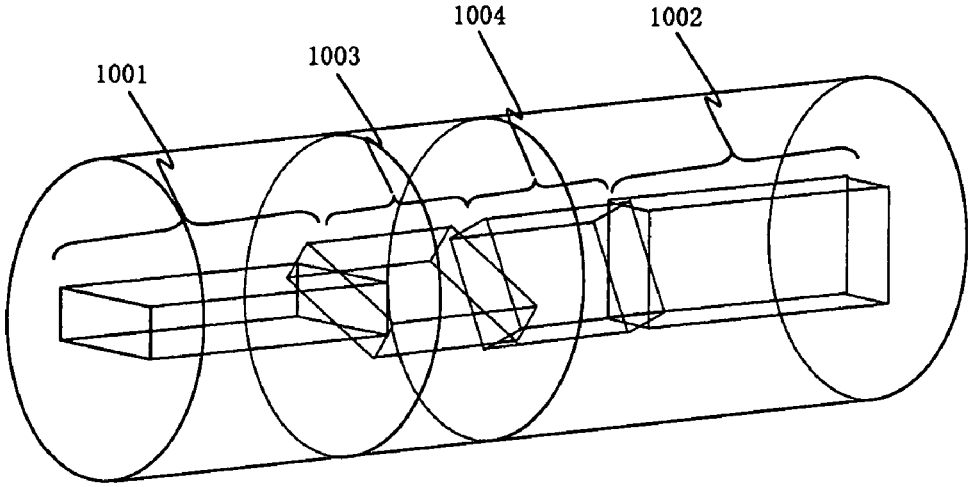
FIG. 2 is a view showing an example of a waveguide apparatus in the case where the vibration directions of input/output polarized waves of waveguides are perpendicular to each other.
Figure 3:
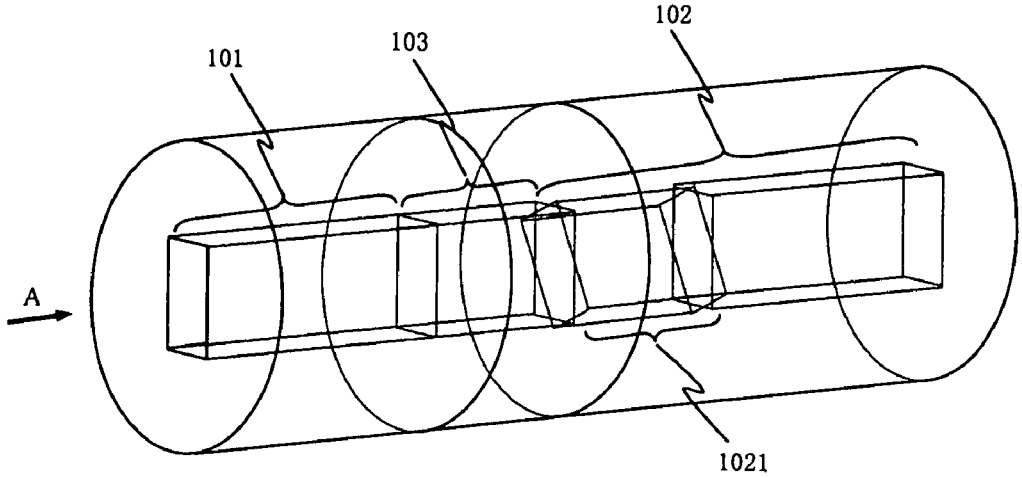
FIG. 3 is a view showing an exemplary embodiment of a waveguide apparatus of the present invention in the case where the vibration directions of input/output polarized waves of waveguides are horizontal to each other.

Referring to FIG. 3, there is illustrated waveguide apparatus comprising waveguide 101 serving as a first waveguide, waveguide 102 serving as a second waveguide, and polarization transformation circuit 103. Moreover, polarization transformation circuit 1021 is embedded within waveguide 102. In this case, waveguides 101 and 102 are disposed so that the vibration directions of polarized waves that passed through the respective waveguides are horizontal to each other, and respective waveguides 101 and 102 are connected through polarization transformation circuit 103.

Figure 4:
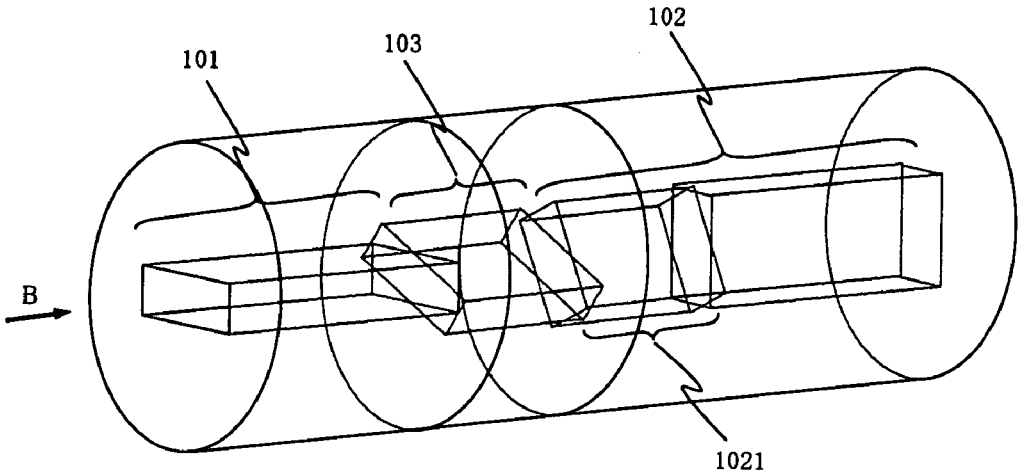
FIG. 4 is a view showing another exemplary embodiment of the waveguide apparatus of the present invention in the case where the vibration directions of input/output polarized waves of the waveguides are perpendicular to each other.

Referring to FIG. 4, there is illustrated the waveguide apparatus, which has a configuration similar to the FIG. 3, and which comprises waveguide 101 serving as the first waveguide, waveguide 102 serving as the second waveguide, and polarization transformation circuit 103. Moreover, polarization transformation circuit 1021 is embedded within waveguide 102. In this case, waveguides 101 and 102 are disposed so that the vibration directions of polarized waves that passed through respective waveguides 101 and 102 are perpendicular to each other, and the respective waveguides are connected through polarization transformation circuit 103.

Polarization transformation circuit 1021 shown in FIGS. 3 and 4 is embedded within waveguide 102 in the state rotated in advance at a suitable angle where impedance matching between waveguides 101 and 102 can be performed only by rotating polarization transformation circuit 103 at a suitable angle. The angle where polarization transformation circuit 1021 is rotated in advance is based on the reflection coefficients of waveguides 101 and 102. Thus, even in the case where waveguides 101 and 102 as shown in FIG. 3 are disposed so that the vibration directions of polarized waves that passed through respective waveguides 101 and 102 are horizontal to each other, it is possible to perform impedance matching between waveguides 101 and 102. Moreover, even in the case where waveguides 101 and 102 as shown in FIG. 4 are disposed so that the vibration directions of polarized waves that passed through the respective waveguides are perpendicular to each other, it is possible to perform impedance matching between waveguides 101 and 102. Namely, as a result of the fact that polarization transformation circuit 1021 is embedded within waveguide 102 in the state rotated in advance at a suitable angle, this is sufficient for performing impedance matching in an electric field horizontally polarized wave and in an electric field vertically polarized wave in order to only rotate polarization transformation circuit 103.

In this example, the lengths of polarization transformation circuit 103 and polarization transformation circuit 1021 are set in advance to ¼ of the waveguide wavelength. Thus, the phase difference at reflection becomes equal to 180 degrees so that the reflection characteristic becomes satisfactory. Moreover, even in the case where the length of polarization transformation circuit 103 is set to ¼ of the waveguide wavelength and the length of polarization transformation circuit 1021 is set to ¾ of the waveguide wavelength, phase difference at reflection becomes equal to 180 degrees so that the reflection characteristic becomes satisfactory. Further, even in the case where the lengths of polarization transformation circuit 103 and polarization transformation circuit 1021 are set to ¾ of the waveguide wavelength, phase difference at reflection becomes equal to 180 degrees so that the reflection characteristic becomes satisfactory.

An angle rotated when polarization transformation circuit 1021 shown in FIGS. 3 and 4 is embedded within waveguide 102 will now be described.

Figure 5:
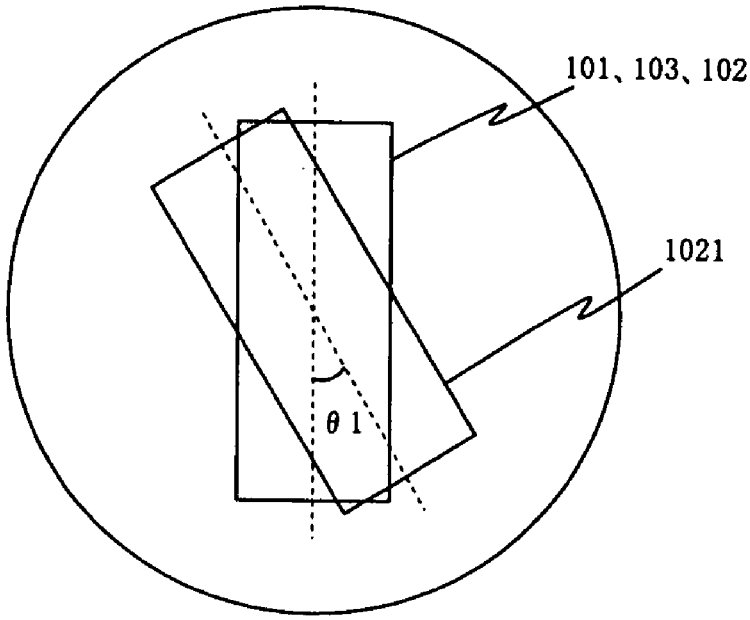
FIG. 5 is a perspective view of the waveguide apparatus of the present invention shown in FIG. 3 when viewed from the direction of A.

As shown in FIG. 5, when the waveguide apparatus of the present invention shown in FIG. 3 is viewed from the direction of A, polarization transformation circuit 1021 is embedded within waveguide 102 in the state rotated at an angle θ1 relative to waveguide 101, polarization transformation circuit 103 and waveguide 102.

Figure 6:
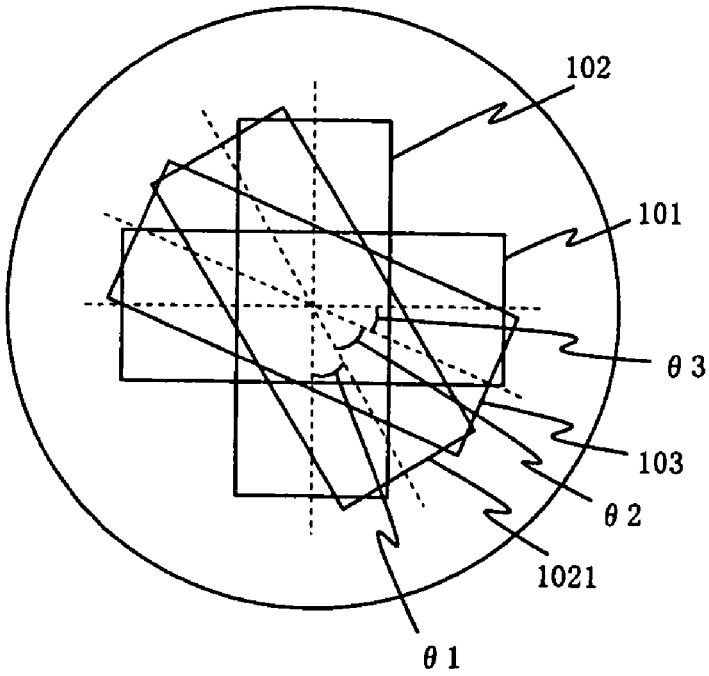
FIG. 6 is a perspective view of the waveguide apparatus of the present invention shown in FIG. 4 when viewed from the direction of B.

As shown in FIG. 6, when the waveguide apparatus of the present invention shown in FIG. 4 is viewed from the direction of B, polarization transformation circuit 1021 is embedded in the state rotated at an angle of θ1 relative to waveguide 102. Moreover, an angle that polarization transformation circuit 1021 and polarization transformation circuit 103 form is assumed to be θ2. Further, polarization transformation circuit 103 is rotated at an angle θ3 relative to waveguide 101.

In FIGS. 5 and 6, respective angles θ1 to θ3 are set based on the reflection characteristic which will be described later. As an angle for obtaining reflection characteristic which will be described later, $$\theta 3:\theta 2:\theta 1=1:\sqrt{2}:1$$

is mentioned as an example. In this case, θ1=about 26°, θ2=about 38° and θ3=about 26° are respectively optimum angles.

Figure 7:
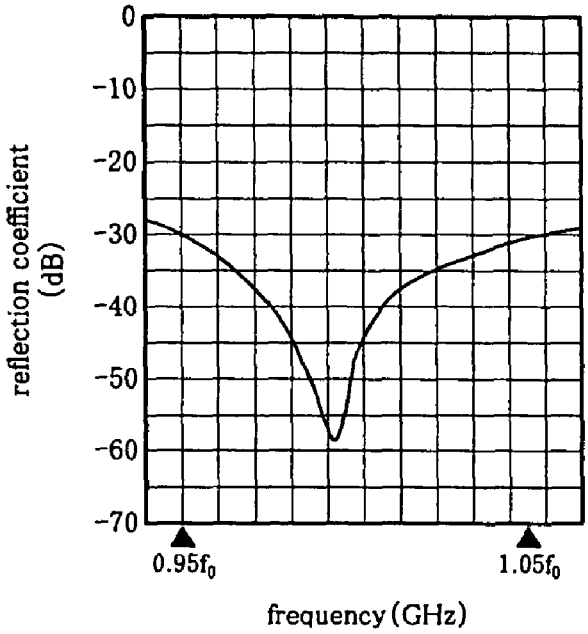
FIG. 7 is a view showing the result in which the reflection characteristic of an electric field horizontally polarized wave in an exemplary embodiment shown in FIG. 3 is measured.

In the reflection characteristics of the electric field horizontally polarized wave in an exemplary embodiment shown in FIG. 3, as shown in FIG. 7, within the range from 0.95 f0 to 1.05 f0 in which the frequency band has a relative bandwidth 10% of polarization frequency f0, the reflection coefficient is below −30 dB which is the target value in the present invention. From this result, it is seen that sufficient reflection characteristics can be obtained in the electric field horizontally polarized wave. In this example, angle θ1 shown in FIG. 5 is set to about 26°. In this case, the abscissa indicates the frequency (GHz) of the polarized wave, and the ordinate indicates the reflection coefficient (dB).

Figure 8:
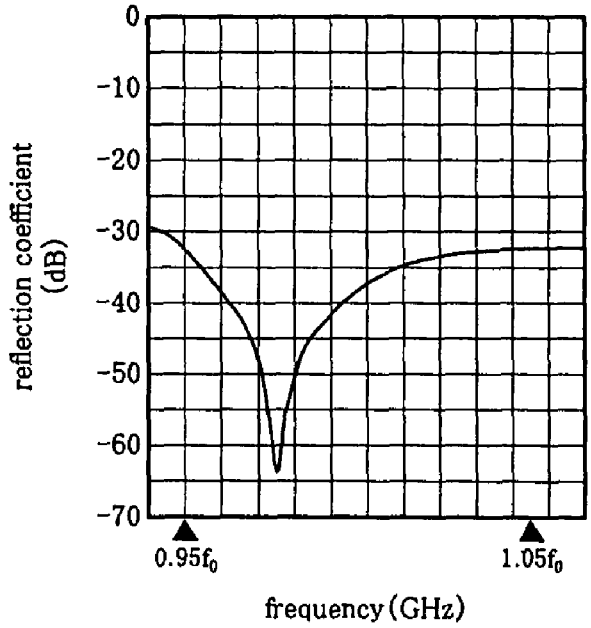
FIG. 8 is a view showing the result in which the reflection characteristic of an electric field vertically polarized wave in an exemplary embodiment shown in FIG. 4 is measured.

In the reflection characteristic of the electric field vertically polarized wave in an exemplary embodiment shown in FIG. 4, as shown in FIG. 8, within the range from 0.95 f0 to 1.05 f0 in which the frequency band has a relative bandwidth 10% of the polarization frequency f0, the reflection coefficient is below −30 dB which is the target value in the present invention. From this result, it is seen that sufficient reflection characteristics can be obtained also in the electric field vertically polarized wave. In this example, angles θ1, θ2 and θ3 shown in FIG. 6 are respectively set to about 26°, about 38° and about 26°. In this case, the abscissa indicates the frequency (GHz) of the polarized wave, and the ordinate indicates the reflection coefficient (dB).

It is to be noted that the relative bandwidth which is the range for determining whether or not the reflection coefficient is suitable can be expanded depending upon the conditions such as the frequency used and the lengths of waveguides 101, 102, etc. For this reason, the above-described suitable angles also vary in accordance with such conditions. Namely, it is necessary to set, as an optimum angle, angles in which the reflection coefficient in the relative bandwidth that correspond to the use condition of the waveguide apparatus at that time is suitable.

As explained above, in the present invention, from among two polarization transformation circuits 103, 1021 which connect waveguides 101 and 102, polarization transformation circuit 1021 is embedded within waveguide 102 in the state rotated at an angle set, based on the reflection coefficient within the waveguide. For this reason, in the case where the vibration direction of a polarized wave that passed through waveguide 101 and the vibration direction of a polarized wave that passed through waveguide 102 are horizontal to each other, it is possible to perform impedance matching between waveguides 101 and 102 just by rotating polarization transformation circuit 103 by a suitable angle. Moreover, also in the case where the vibration direction of a polarized wave that passed through waveguide 101 and the vibration direction of a polarized wave that passed through waveguide 102 are perpendicular to each other, it is possible to perform impedance matching between waveguides 101 and 102 just by rotating polarization transformation circuit 103 by a suitable angle. Thus, the number of parts can be reduced through the integration of parts and polarization wave switching work can be facilitated.

Moreover, any other polarization transformation circuit may be disposed between waveguides 101 and 102.

Further, a polarization transformation circuit whose length is set to the length of ¼ of each waveguide wavelength of waveguides 101 and 102 may be embedded within waveguide 102, and the length of the other polarization transformation circuit may be set to ¼ of each waveguide wavelength of waveguides 101 and 102.

Further, a polarization transformation circuit whose length is set to the length of ¾ of each waveguide wavelength of waveguides 101 and 102 may be embedded within waveguide 102, and the length of the other polarization transformation circuit may be set to ¼ of each waveguide wavelength of waveguides 101 and 102.

In addition, a polarization transformation circuit whose length is set to the length of ¾ of each waveguide wavelength of waveguides 101 and 102 may be embedded within waveguide 102, and the length of the other polarization transformation circuit may be set to ¾ of each waveguide wavelength of waveguides 101 and 102.

While an exemplary embodiment of the present invention has been described in specific terms, such description is for illustrative purpose only, and it is to be understood that changes and variations may be made without departing from the spirit or scope of the following claims.

What is claimed is:

1. An apparatus, comprising:

a first waveguide;

a second waveguide;

a polarization transformation circuit embedded within the second waveguide in a state rotated relative to the second waveguide at an angle set, based on a reflection characteristic indicating a characteristic of a reflection coefficient with respect to a polarization frequency; and a rotatable polarization transformation circuit disposed between the first and second waveguides.

2. The apparatus according to claim 1, wherein the polarization transformation circuit, embedded within the second waveguide, comprises a length of ¼ of each waveguide wavelength of the first and second waveguides, and a length of the rotatable polarization transformation circuit comprises ¼ of each waveguide wavelength of the first and second waveguides.

3. The apparatus according to claim 1, wherein the polarization transformation circuit, embedded within the second waveguide, comprises a length of ¾ of each waveguide wavelength of the first and second waveguides, and a length of the rotatable polarization transformation circuit comprises ¼ of each waveguide wavelength of the first and second waveguides.

4. The apparatus according to claim 1, wherein the polarization transformation circuit, embedded within the second waveguide, comprises a length of ¾ of each waveguide wavelength of the first and second waveguides, and a length of the rotatable polarization transformation circuit comprises ¾ of each waveguide wavelength of the first and second waveguides.

5. The apparatus according to claim 1, wherein the angle, at which the embedded polarization transformation circuit is rotated, is sufficient for performing impedance matching in an electric field horizontally polarized wave and in an electric field vertically polarized wave, with only a further rotation of the rotatable polarization transformation circuit.

6. The apparatus according to claim 1, wherein an angle of embedded polarization transformation circuit relative to the second waveguide is 26 degrees, an angle of the embedded polarization transformation circuit relative to the rotatable polarization transformation circuit is 38 degrees, and an angle of the other polarization circuit relative to the first waveguide is 26 degrees.

7. A method of fabricating a waveguide apparatus, comprising:

providing a first waveguide, a second waveguide and a rotatable polarization transformation circuit;

embedding a polarization transformation circuit in said second waveguide in a state rotated at an angle relative to the second waveguide; and disposing the rotatable polarization transformation circuit between the first and second waveguides.

8. The method of fabricating a waveguide apparatus according to claim 7, wherein the angle is based on a reflection characteristic indicating a characteristic of a reflection coefficient with respect to a polarization frequency.

9. The method of fabricating a waveguide apparatus according to claim 7, wherein the polarization transformation circuit, embedded within the second waveguide, comprises a length of ¼ of each waveguide wavelength of the first and second waveguides, and a length of the rotatable polarization transformation circuit comprises ¼ of each waveguide wavelength of the first and second waveguides.

10. The method of fabricating a waveguide apparatus according to claim 7, wherein the polarization transformation circuit, embedded within the second waveguide, comprises a length of ¾ of each waveguide wavelength of the first and second waveguides, and a length of the rotatable polarization transformation circuit comprises ¼ of each waveguide wavelength of the first and second waveguides.

11. The method of fabricating a waveguide apparatus according to claim 7, wherein the polarization transformation circuit, embedded within the second waveguide, comprises a length of ¾ of each waveguide wavelength of the first and second waveguides, and a length of the rotatable polarization transformation circuit comprises ¾ of each waveguide wavelength of the first and second waveguides.

12. The method of fabricating a waveguide apparatus according to claim 7, wherein the angle, at which the embedded polarization transformation circuit is rotated, is sufficient for performing impedance matching in an electric field horizontally polarized wave and in an electric field vertically polarized wave, with only a further rotation of the rotatable polarization transformation circuit.

13. The method of fabricating a waveguide apparatus according to claim 7, wherein an angle of the embedded polarization transformation circuit relative to the second waveguide is 26 degrees, an angle of embedded polarization transformation circuit relative to the rotatable polarization transformation circuit is 38 degrees, and an angle of the rotatable polarization circuit relative to the first waveguide is 26 degrees.

* * * * *